United States Patent [19]

Bergendal

[11] Patent Number: 4,575,616

[45] Date of Patent: Mar. 11, 1986

[54] DOMESTIC INFRA-RED RADIATION OVEN

[75] Inventor: Lars R. G. Bergendal, Lidingö, Sweden

[73] Assignee: Aktiebolaget Electrolux, Stockholm, Sweden

[21] Appl. No.: 541,326

[22] PCT Filed: Feb. 3, 1983

[86] PCT No.: PCT/SE83/00035

§ 371 Date: Sep. 26, 1983

§ 102(e) Date: Sep. 26, 1983

[87] PCT Pub. No.: WO83/02817

PCT Pub. Date: Aug. 18, 1983

[30] Foreign Application Priority Data

Feb. 5, 1982 [SE] Sweden ..... 8200685

[51] Int. Cl.[4] ..... F24C 7/06

[52] U.S. Cl. ..... 219/405; 219/411

[58] Field of Search ..... 219/405, 408, 409, 410, 219/411, 479, 354, 391, 392, 395, 396, 397, 398; 99/331, 341; 126/190, 197, 198, 273 R, 273 A

[56] References Cited

U.S. PATENT DOCUMENTS

| | | | |
|---|---|---|---|
| 2,764,664 | 9/1956 | Stewart | 219/410 |
| 2,824,943 | 2/1958 | Laughlin | 219/411 |
| 2,860,225 | 11/1958 | Steen | 219/396 |
| 2,864,932 | 12/1958 | Forrer | 219/521 |
| 2,922,018 | 1/1960 | Walkoe | 219/396 |
| 3,161,755 | 12/1964 | Tilus | 219/405 |
| 3,241,545 | 3/1966 | Reinert | 219/391 |
| 3,249,741 | 5/1966 | Mills | 219/411 |
| 4,164,643 | 8/1979 | Peart | 219/411 |
| 4,208,573 | 6/1980 | Risse | 219/411 |
| 4,238,669 | 12/1980 | Huntley | 219/398 |

FOREIGN PATENT DOCUMENTS

| | | | |
|---|---|---|---|
| 0040528 | 11/1981 | European Pat. Off. | 219/405 |
| 2006621 | 8/1971 | Fed. Rep. of Germany | 219/391 |
| 2546106 | 4/1977 | Fed. Rep. of Germany | 219/405 |

*Primary Examiner*—O. L. Albritton
*Assistant Examiner*—Teresa J. Walberg
*Attorney, Agent, or Firm*—Alfred E. Miller

[57] ABSTRACT

A domestic oven has upper and lower infra-red radiation sources. The upper radiation source includes at least one or two radiation elements emitting radiation in the range of 1.0–1.4 micro meters. The lower radiation source is a meandering tube element emitting long wave radiation in the range of 3–6 micro meters.

8 Claims, 4 Drawing Figures

DOMESTIC INFRA-RED RADIATION OVEN

This invention relates to a domestic infra-red radiation oven.

Domestic ovens comprising radiation elements which emit radiation in the infra-red wavelength range are used both for conventional cooking and baking and for thawing and heating of precooked frozen food portions. The advantage of radiation elements over heating elements, which by heating the air transfer heat to the oven load, is that the transfer of heat is quicker and thus results in shorter treatment times. It is known in connection with the thawing of frozen, aqueous food that IR-radiation of a wavelength less than 1.0 μm readily penetrates into the food whereas for wavelengths greater than 1.4 μm the radiation is absorbed substantially in the surface layer. For wavelengths in the range of 1.0–1.4 μm both penetration and absorption are obtained.

The main object of the invention is to provide an oven of the said type which is designed for thawing and heating of precooked, frozen food portions and which, compared to a convection oven, requires a considerably shorter treatment time and at the same time reduces the consumption of energy.

Another object is to design and locate the radiation elements in such a way that a uniform heating of the load is achieved.

Still another object is to prevent, in the event that the oven has a door with an inspection glass, short-wave infra-red radiation from escaping to any significant extent through the door.

An embodiment of the invention will now be described with reference to the accompanying drawings.

Figure 1:
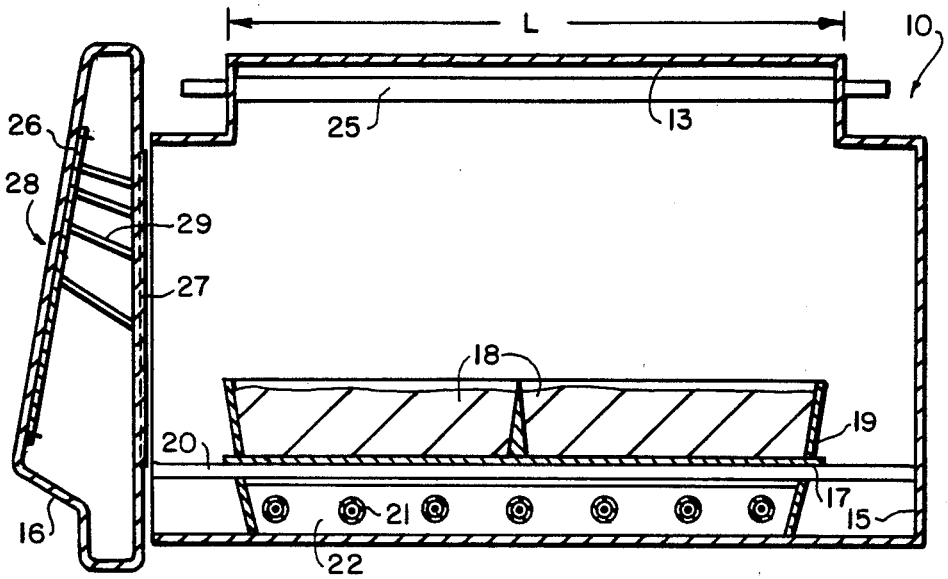
FIG. 1 is a longitudinal section through an oven made in accordance with the invention.

The oven has a generally parallelepiped oven space 10 defined by two side walls 11, 12, a top wall 13, a bottom wall 14, a rear wall 15 and a front wall constituted by a door 16. A support plate 17 carries the oven load 18, which in the example is a frozen fish au gratin placed in a tin 19, suitably of aluminium with blackened surface. The support plate is of a material transparent to IR-radiation, for example temperature-resistant glass. Alternatively, the support plate can be in the form of a gridiron. The support plate rests on flanges 20 provided in the side walls 11, 12. Such flanges can be disposed at different levels in the oven so as to allow adjustment of the position of the support plate.

At the bottom wall 14 of the oven a radiation source is arranged for long-wave IR-radiation in the wavelength range of 3–6 μm. The radiator comprises a tube element 21 bent in a meandering shape. The tube element is disposed in a reflector 22 which reflects downwardly emitted radiation to the underside of the tin 19 in order to heat it. Thus, the tube element 21 heats the tin, from which heat is transferred to the food portion au gratin by conduction. This type of radiator is suitable in the present case because frozen food on thawing and heating is often positioned on a vessel which is not pervious to IR-radiation. Furthermore, the lower radiation element is often soiled by grease and food falling onto it and sticking thereto by burning. A tube element of metal is easier to clean than the quartz-tube radiators which are used as upper radiation elements and which will be described in the following. The extension of the reflector 22 preferably coincides with the extension of the tin 19, which is shown as a double-tin, i.e. it comprises two tins which are held together and each one contains one portion.

If the tube element 21 is selected for a surface load $\geqq 3$ W/cm$^2$ it has proved to be suitable to place the support plate 17 such that the distance between its supporting surface and the tube element will be about 30 mm. Further, the tube element should have a thermal mass which does not exceed 7 g/dm tube length to ensure that the time derivative for the increase in the radiation from this element is of equal magnitude as for the normally very rapid quartz-tube radiators.

In the upper part of the oven three straight radiation elements of quartz-tube type 23,24,25 are disposed. Their ends project a little out of the oven space so as to be connected to an electric power source, not shown. In the illustrated embodiment, the elements 23–25 are parallel to the side walls 11, 12, but the elements can just as well be arranged so as to be parallel to the rear wall 15 and the door 16, respectively. These radiation elements emit IR-radiation in the wavelength range of 1.0–1.4 μm with peak performance at 1.2 μm. In this wavelength range the radiation can penetrate the surface layer of the load, in the example the fish au gratin, and heating be accomplished down to the bottom of the food. This contributes substantially to the reduction of the required treatment time.

For the radiation elements 23–25 more or less complex mathematical relationships can be established for different conditions as regards the number of elements and their positioning, i.e. whether they are perpendicular or parallel to the door. These relationships are meant to show at what distances between the radiation emitting plane and the support plane of the support plate 17 as well as between the radiation elements the optimal heating of the different parts of the load is obtained. Three different examples will now be related in which the elements give a uniformly distributed heating effect without burning of the edges of the load, which otherwise frequently occurs. The thickness of the load must in this case not exceed 5 cm, and hence the radiation intensity will be higher in the central part than in the edges of the load.

Two tube elements parallel to the side walls 11, 12

Figure 2:
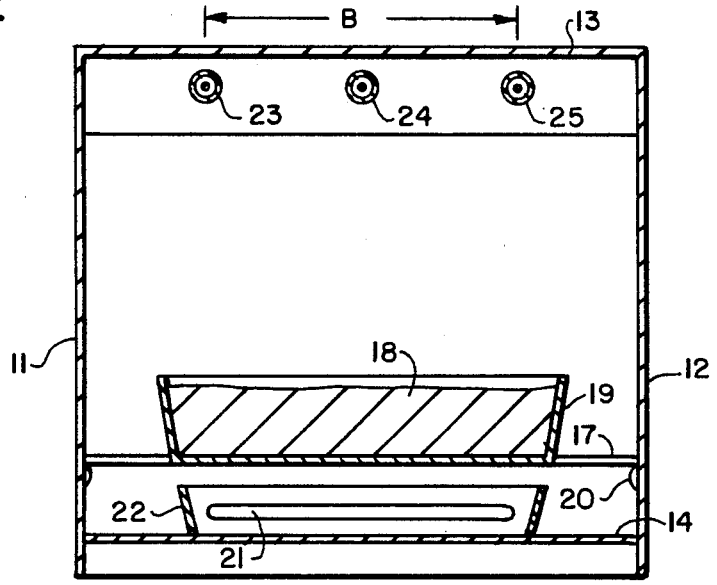
FIG. 2 is a cross section through the oven of FIG. 1.

Calculations and tests have shown that the vertical distance between the plane through the radiation elements and the plane of the support plate shall be between 40 and 70% of the active length, designated by L in FIG. 1, of the elements. Furthermore, the distance between the elements shall be between 40 and 60% of the distance, designated by B in FIG. 2, between the side walls. The elements are symmetrically disposed relative to the side walls 11, 12.

Three tube elements parallel to the side walls 11, 12

In this case calculations and tests have shown that the distance between radiation plane and load shall be chosen as in the case with two elements. The relative distance selected between the elements, however, shall be between 30 and 50% of the distance B.

Figure 4:
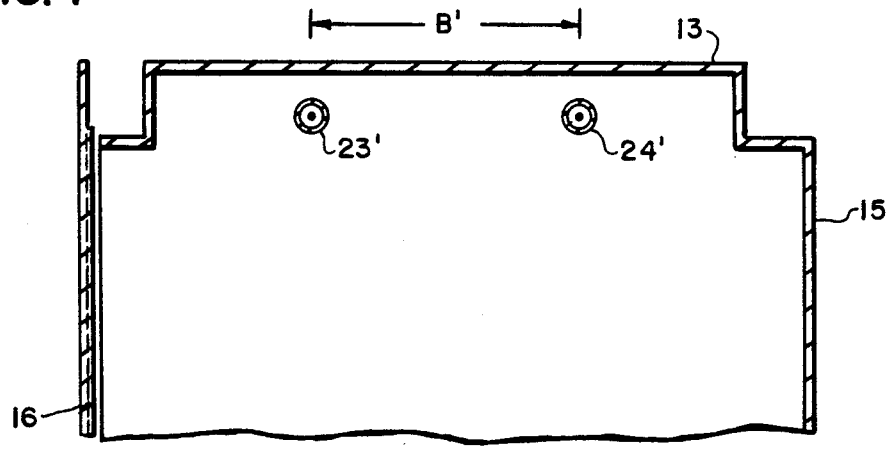
FIG. 4 is a modification in cross section of a portion of the oven of FIG. 1.

Two tube elements 23', 24' parallel to the door 16 as shown in FIG. 4

Provided that the stationary oven walls have the same reflection coefficient there will be problems if the reflection coefficient of the door is different. Normally, the reflection of the door is inferior to the reflection of the other oven walls and the mathematical relationship governing in this case will be very complex. However, by calculations it can be concluded that acceptable results are obtained if the distance B' between the elements is between 45 and 65% of the distance between the walls parallel to the elements, in the present case the door 16 and the rear wall 15. This condition prevails provided the reflection coefficient of all walls except the door is between 0.4 and 0.8.

As appears above the radiation elements 23–25 emit short-wave IR-radiation which may damage the eyes of an observer should it penetrate with sufficient intensity through an opening 28 arranged in the door 16 and covered by glass 26, 27. One way of reducing the intensity is to increase the reflection of the inner glass 27 of the door, which can be done by a layer of tin oxide. Another way is to arrange a blind 29 preventing observation of the radiation elements 23–25 in the top wall of the oven from any point outside the closed door whereas the load is fully visible.

Figure 3:
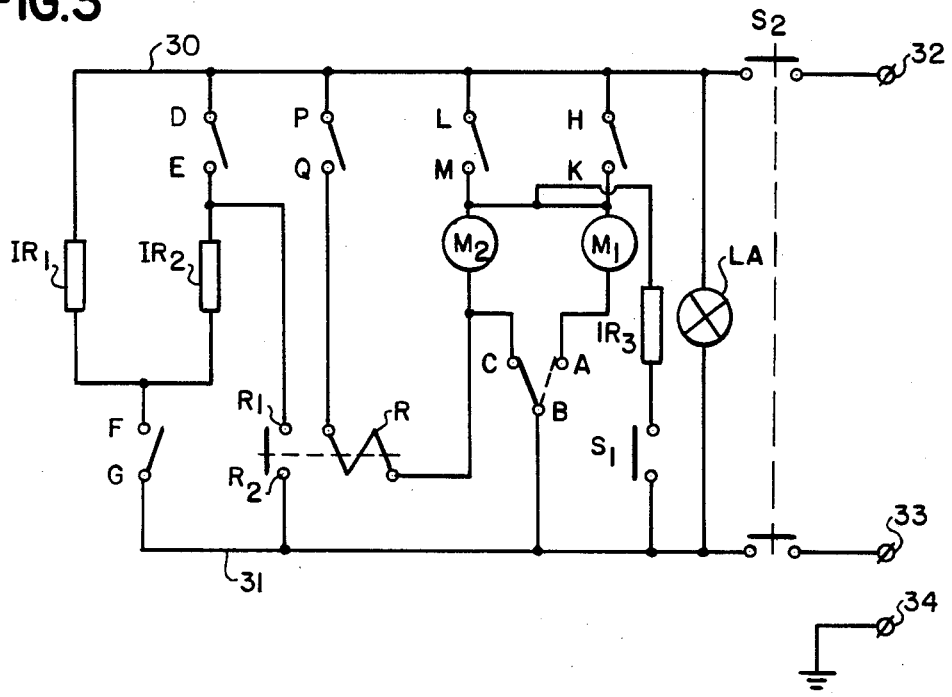
FIG. 3 is a circuit diagram of a system for controlling the energy supply and the treatment time suitable for the oven.

For thawing and heating most foodstuffs require two different power levels in order for a fully satisfactory result to be obtained. During the first $t_1$ minutes of the process the short-wave IR-power level $P_1$ is used and during the subsequent $t_2$ minutes the power level $P_2$ is used. The relation between $P_1$ and $P_2$ should for thawing of a foodstuff mass of 0.5–1.5 kg be 0.15 $P_1 \leqq P_2 \leqq 0.30P_1$. The two cycle times $t_1$ and $t_2$ must be variable because these times depend on the type of foodstuff. A suitable system for controlling the energy supplied and the treatment time is shown in FIG. 3. The upper radiation source here includes two radiation elements of quartz type, designated by $IR_1$, $IR_2$ and each one having an output of 1000 W. The lower radiation source is designated by $IR_3$ and has an output of 1300 W. The element $IR_1$ is connected between two feed conductors 30, 31 via two contacts F, G. The element $IR_2$ is connected to the conductor 30 via two contacts D, E and to the conductor 31 via the contacts F, G. The contact E is further connected to the conductor 31 via two contacts $R_1$, $R_2$ of a relay R. The winding of the relay is connected via contacts P, Q to the conductor 30 and further via contacts C, B to the conductor 31.

For controlling the switched-in times of the radiation elements $IR_1$–$IR_3$ two timer motors $M_1$, $M_2$ are provided. The timer $M_2$ is connected to the conductor 30 via two contacts L, M and to the conductor 31 via the contacts C, B. The timer $M_1$ is connected to the conductor 30 via two contacts H, K and to the conductor 31 via two contacts A, B. The contacts M and K are interconnected and also connected to the element $IR_3$, which is connected to the conductor 31 via a switch $S_1$. The conductors 30, 31 are connected to terminals 32, 33 via a two-pole main switch $S_2$, and the voltage connected is indicated by a signal lamp LA connected between the conductors 30, 31. The complete circuit diagram includes a ground connection 34. The timer $M_1$ controls the contacts A-B-C, D-E, F-G and H-K whereas the timer $M_2$ controls the contacts P-Q and L-M.

The function of the circuit arrangement will now be described, and it is assumed that the upper elements $IR_1$, $IR_2$ are to be connected so as to supply the higher output $P_1$ during the time $t_1$, after which during the time $t_2$ they are to supply the lower output $P_2$. The element $IR_3$ shall simultaneously be continuously connected.

First the timer $M_1$ is set for the time $t_1$ and the timer $M_2$ for the time $t_2$. When the timer $M_1$ has been set it has simultaneously closed the contacts A-B, D-E, F-G and H-K. Corresponding setting of the timer $M_2$ closes the contacts L-M and P-Q. When thereafter the main switch $S_2$ is closed the feed conductors 30, 31 are connected to voltage so that the timer $M_1$ starts counting down from the time $t_1$ to 0. Via the contacts D-E and F-G the elements $IR_1$ and $IR_2$ are connected in parallel to the feed conductors 30, 31 and via the contacts H-K and the switch $S_1$, being in "on-position", the element $IR_3$ is connected.

When the timer $M_1$ after the time $t_1$ has reached the zero position the contacts A-B open and the contacts B-C close. Further the contacts D-E, F-G and H-K open. This causes the current to the elements $IR_1$ and $IR_2$ to be broken whereas the relay R receives current and pulls and closes the contacts $R_1$, $R_2$. Thereby the elements $IR_1$, $IR_2$ will be connected in series between the feed conductors 30, 31 to supply the lower output $P_2$. At the same time as the timer $M_1$ stopped, the timer $M_2$ was started by a circuit being established between the feed conductors 30, 31 via the contacts B-C and L-M. By the latter contacts current is supplied to the element $IR_3$ which remains connected also during the time $t_2$. When this time has lapsed and the timer $M_2$ has reached the zero position the contacts L-M and P-Q open and hence the supply of current to all elements $IR_1$–$IR_3$ will be broken.

If only the timer $M_1$ is activated and set for example on the time $t_1$ the elements $IR_1$–$IR_3$ will be connected in parallel during the time set.

The switch $S_1$ is arranged in order to make it possible to heat solely by means of the upper elements $IR_1$, $IR_2$, for example for gratinating. Then the lower element is disconnected.

As an alternative, the control system shown in FIG. 3 can be replaced by an electronic unit which for example by pulse width modulation or by phase control can regulate the energy supplied to all of the radiaton elements.

I claim:

1. In a domestic oven having a generally parallelepiped oven space with walls of a material which is highly reflective of infra-red radiation, one side wall being a door, and an upper and a lower radiation source arranged at top and bottom walls repectively of the oven, the radiation sources emitting infra-red radiation and a supporting surface substantially transparent to the radiation and arranged between the two radiation sources and adapted to support an oven load, the upper radiation source being arranged to emit short-wave IR-radiation with a peak performance in a wavelength range of 1.0 to 1.4 μm, the improvement wherein the upper radiation source is comprised of at least one straight rod-shaped quartz-tube radiation element having an active length and being in a plane parallel to the top wall of the oven, the oven having a vertical distance from the rod-shaped radiation element to said supporting surface that is 40–70% of the active length of the radiation element.

2. An oven according to claim 1, wherein the lower radiation source is a tube element placed above a flat reflector at a distance from the reflector which is less than 15 mm, the tube element being in a plane parallel to the reflector and to said supporting surface (17) supporting the vessel and at a distance less than 30 mm from the supporting surface.

3. An oven according to claim 2, wherein the tube element has a mass less than 7 g/dm tube length with a load of at least 3 Watts per square centimeter of its surface.

4. An oven according to claim 2 or claim 3, wherein the vessel has a size and shape to cover both the tube element and the reflector.

5. An oven according to claim 1, wherein the oven space has two side walls spaced apart a given distance and the upper radiation source is comprised of two radiation elements disposed symmetrically and parallel relative to one another and to the two side walls of the oven, the side walls having the same reflection coefficient, the radiation elements being spaced apart with a distance therebetween of from 40 and 60% of said distance between the side walls.

6. An oven according to claim 1, wherein the oven space has two side walls spaced apart a given distance and the upper radiation source is composed of three radiation elements disposed symmetrically in the oven and parallel relative to one another and to the two side walls of the oven, the two side walls having the same reflection coefficient and the radiation elements being spaced apart with a distance therebetween of from 30 and 50% of said distance between the side walls.

7. An oven according to claim 1, wherein the oven space has two side walls with a distance therebetween and the upper radiation source is comprised of two radiation elements disposed symmetrically and parallel relative to one another and to the two side walls, the two side walls having reflection coefficients being 0.4 and 0.8, one side wall comprising the door and having a lower reflection coefficient than the opposed side wall, the radiation elements further being spaced apart between 45 and 65% of the distance between the side walls.

8. An oven according to claim 1, wherein the door has an inspection glass and a fixed blind-like screen arranged for allowing inspection of the oven space and at the same time for preventing direct radiation of the upper radiation source from escaping through the inspection glass.

* * * * *